United States Patent [19]

Wenner

[11] 4,273,256

[45] Jun. 16, 1981

[54] APPARATUS FOR DISPENSING PRINTED PRODUCTS

[76] Inventor: Hans Wenner, Lessingstrasse 40, 6901 Eppelheim, Fed. Rep. of Germany

[21] Appl. No.: 951,358

[22] Filed: Oct. 13, 1978

[30] Foreign Application Priority Data

Oct. 15, 1977 [DE] Fed. Rep. of Germany ... 7731990[U]

[51] Int. Cl.[3] ..... B65H 1/14; B65H 3/24; G07F 11/14

[52] U.S. Cl. ..... 221/230; 221/232; 221/241

[58] Field of Search ..... 221/232, 230, 227, 226, 221/213-216, 271, 241

[56] References Cited

U.S. PATENT DOCUMENTS

| | | | |
|---|---|---|---|
| 1,171,478 | 2/1916 | Tintera | 221/232 X |
| 1,314,217 | 8/1919 | Roberts | 221/232 X |
| 1,696,447 | 12/1928 | Paulson | 221/241 X |
| 1,749,233 | 3/1930 | Scott | 221/232 |
| 3,438,546 | 4/1969 | Wenner | 221/215 |
| 3,709,405 | 1/1973 | Harris | 221/232 X |

*Primary Examiner*—F. J. Bartuska
*Attorney, Agent, or Firm*—Staas & Halsey

[57] ABSTRACT

An apparatus for dispensing printed products such as newspapers or periodicals from the top of a stack within a housing from which a manually rotatable knob protrudes. Two toothed detent rods are vertically mounted on the rear wall of the housing, one detent rod being fixed and the other being freely movable, and a transport plate on which the periodical stack rests is movably mounted adjacent the detent rods. A lever pivoted on one end and attached on the other by a cable operated by the knob extends under the detent rods, with the movable detent rod being positioned to rest on the lever. Two spring biased pawls are mounted on the transport plate to engage the detent rod, so that the transport plate is jacked-up as the lever moves while periodicals are dispensed. Two height regulator mechanisms, including a bolt protruding from the movable detent rod and a movable bar having an upper extended part for resting on the top of the periodical stack and a lower part extending beneath the lever, are disclosed for cooperating with the movable detent bar to regulate the distance the transport plate is raised when the periodicals are dispensed. Several pushing mechanisms for expelling the uppermost printed product through a delivery slot in the housing when the knob is operated are also disclosed.

17 Claims, 15 Drawing Figures

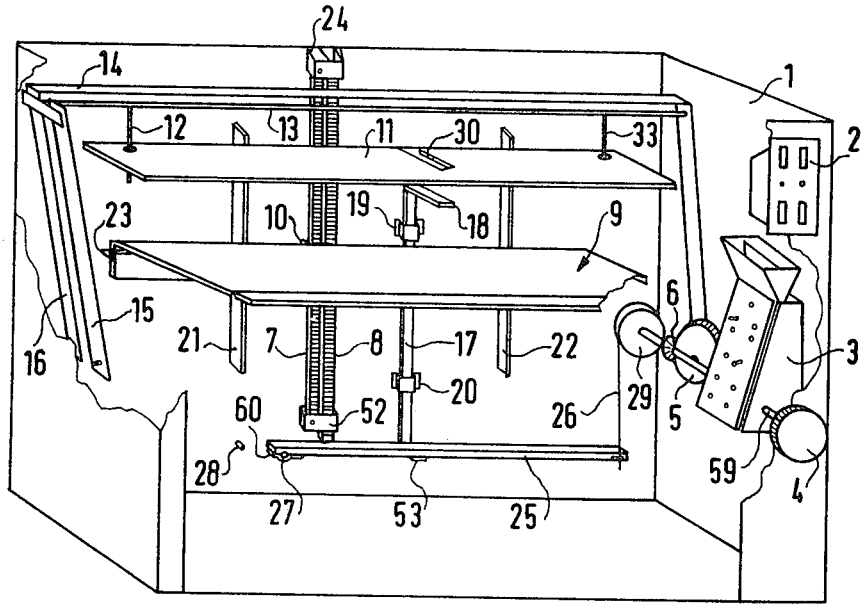
FIG. 1
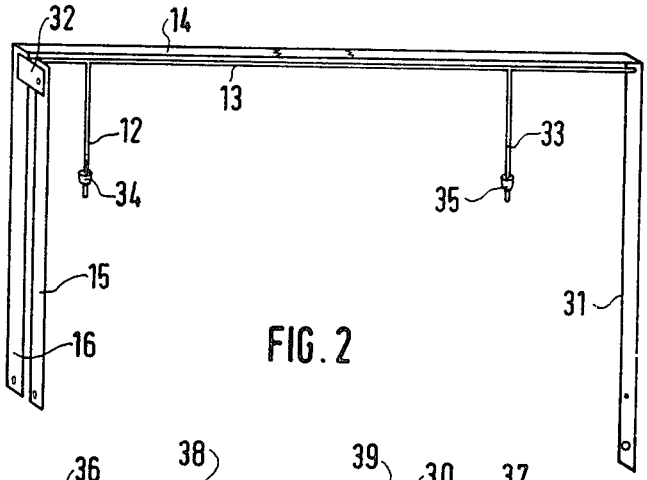
FIG. 2
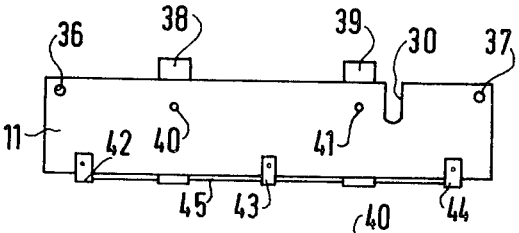
FIG. 3
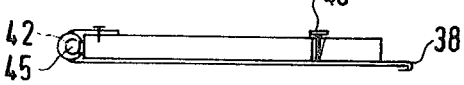
FIG. 4
FIG. 10
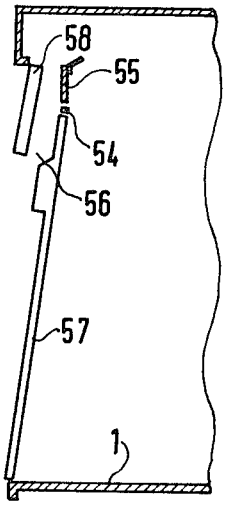

APPARATUS FOR DISPENSING PRINTED PRODUCTS

BACKGROUND OF THE INVENTION

The invention relates to an apparatus for dispensing folded or stitched printed products, such as newspapers or periodicals, consisting of a housing with an automatic coin mechanism and a turning device which, after coin insertion, by rotation delivers a printed product through a delivery slot.

Various devices with automatic coin mechanisms for dispensing goods are known. Automatic machines are also already known for newspapers, periodicals and the like, where the newspapers for example are stacked horizontally in the interior of the machine. The delivery mechanism of such automatic machines for printed products is, however, susceptible to faults and does not guarantee satisfactory service, so that often the periodicals are damaged in delivery and withdrawal by the purchaser.

The invention is therefore based upon the problem of producing a device of the initially stated classification which renders possible satisfactory delivery of folded or stitched printed products after coin insertion.

SUMMARY OF THE INVENTION

The solution to the problem consists in that, in accordance with the invention, a detent rod is fixedly arranged perpendicularly on the rear wall of the housing, parallel therewith a further detent rod is arranged for upward and downward displacement. Each rod engages a pivotal pawl of a vertically displaceable transport plate for carrying the stack of printed products, while above the transort plate a push plate is pivotably arranged for grasping and pushing out the printed product placed uppermost on the stack. Beneath the ends of the detent rods a lever pivotable about an axis is arranged approximately horizontally, and the movable detent rod stands on the lever.

The outstanding advantage of the present device in accordance with the invention consists in that with this device, after coin insertion and rotation of the turning device, a printed product can be taken from the device satisfactorily and without any fault. The entire mechanism is robust, simple and trouble-proof.

Due to this movable detent rod an intermediate setting of the printed product stack is possible in an extremely advantageous manner if the thickness of an individual printed product does not correspond exactly to the interval of two teeth of the fixed detent rod.

In a further development in accordance with the invention, the push plate can be retained by means of a stirrup piece which is rotatably mounted on the lateral housing walls and which can be moved toward the front plate. The push plate can here comprise at least two hooks for grasping the printed product lying uppermost of the stack. Thus in an advantageous manner the printed product is securely grasped and pushed out by the hook after coin insertion and rotation of a twist knob of the turning device.

In a further development in accordance with the invention, a vertically displaceable rod can be mounted perpendicularly on the housing rear wall, which rod comprises an upper and a lower horizontal angle, piece the upper resting on the printed product stack and the lower extending beneath the lever. In an extremely advantageous manner this rod renders possible an intermediate setting of the printed product stack if the thickness of an individual printed product does not correspond exactly to the interval of two teeth of the fixed detent rod. In this case the upper angle piece of the rod rests on the printed product stack and the lower angle piece holds the lever fast in an intermediate position so that the freely movable detent rod cannot return completely into its lowermost position.

Moreover the free end of the lever may engage a draw cable which is looped over a pulley which is fitted on the drive shaft of the turning device. Furthermore a pinion can be fitted on the drive shaft of the turning device, which pinion engages in a toothed wheel which again is connected with the stirrup piece for the pivoting of the push plate.

Moreover the forward part of the transport plate can be arranged by means of a hinge or piano cord for pivoting against the force of springs which retain the forward part with the remaining part of the transport plate in the horizontal position.

Further developments of the invention are characterised in further dependent claims which are hereby expressly included in the text.

BRIEF DESCRIPTION OF THE DRAWINGS

An example of embodiment of the invention is described below and illustrated in the drawing, wherein:

FIG. 1 shows a perspective view of the device after removal of the front plate and the left side wall, FIG. 2 shows a representation of the stirrup piece carrying the push plate, FIG. 3 shows a plan view of the push plate, FIG. 4 shows a lateral view of FIG. 3, FIG. 10 shows a partial cross-section through the forward part of the housing to illustrate the arrangement of the front plate.

DETAILED DESCRIPTION

Figure 5:
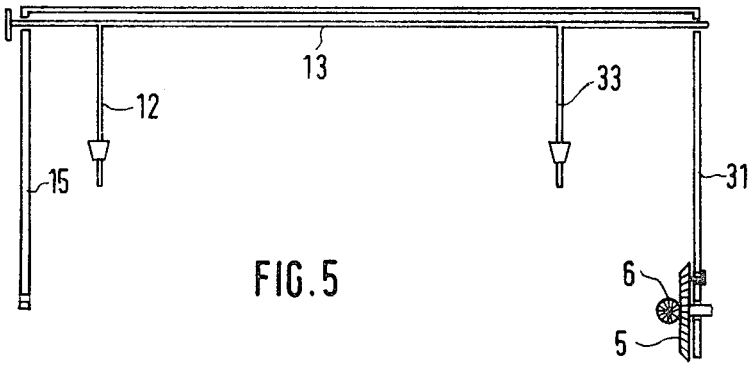
FIG. 5 shows a view of the stirrup piece with the pivoting mechanism consisting of a pinion and a bevel gear which rotates the stirrup piece.
Figure 6:
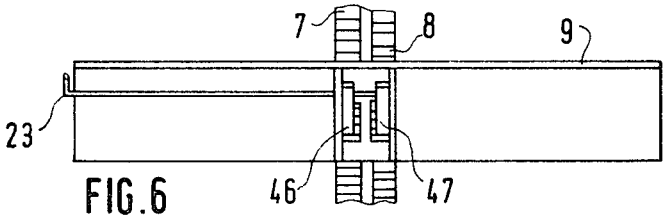
FIG. 6 shows a view of the transport plate with its retention on the detent rods.
Figure 7:
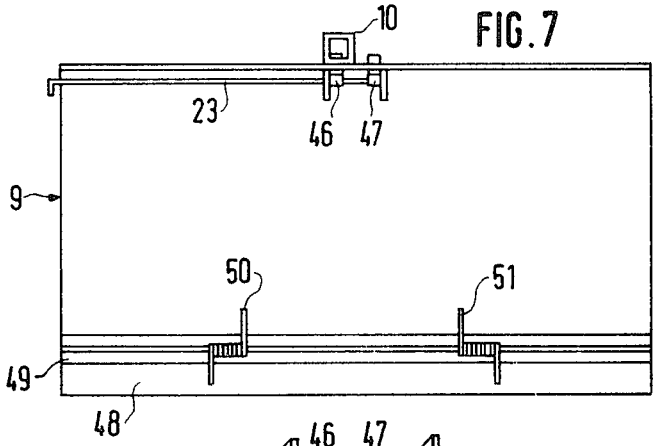
FIG. 7 shows a view of the transport plate from beneath.
Figure 8:
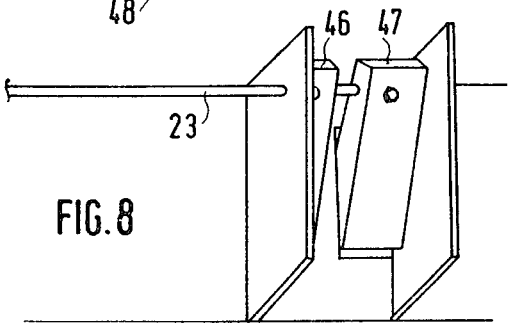
FIG. 8 shows a perspective representation of the pawls of the transport plate which engage in the detent rods.

According to FIG. 1 the device according to the invention consists of a housing 1, preferably a sheet steel housing, in which a coin insertion part 2 with a coin mechanism 3 are arranged. The coin mechanism 3 is coupled with a turning device consisting of a shaft 59 which is arranged within the coin mechanism 3 and penetrates the housing to the front, a twist knob 4 being fitted on this end of the shaft 59. On the other end of the shaft there are fitted a pulley 29 and a pinion 6. The pinion 6 meshes with a bevel wheel 5 which is suitably rotatably mounted on the lateral housing wall. The front plate 57 (FIG. 10) of the housing 1 extends obliquely with rearward inclination from the bottom upwards, so that a delivery slot 56 is formed between the front plate 57 and a mask 58. Within this covering 58, which can be of "plexiglas", it is possible to display one or two copies of the printed product concerned.

On the rear wall of the housing 1 a vertical detent rod 7 is fixedly mounted, possessing for example teeth of saw-tooth form with a horizontal flank and an obliquely descending flank, the detent rod being fitted in such a way that the perpendicular flanks of the teeth extend horizontally. Beside the fixedly mounted detent rod 7 there is movably mounted parallel therewith another detent rod 8 of similar formation. Rod 8 is mounted for vertical displacement by an upper slide sleeve 24 and a lower slide sleeve 52.

Figure 9:
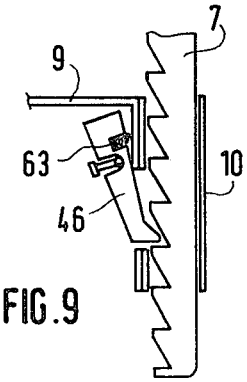
FIG. 9 shows a lateral view of a detent rod and a pawl to illustrate the engagement of the latter in the detent rod.

The rear of transport plate 9 possesses a perpendicularly arranged guide sleeve 10 (see also FIG. 9) which grasps around the fixed detent rod 7 and serves for the upward and downward guidance of the transport plate 9 along the detent rod 7. According to FIGS. 6 to 9 in the region of the guide sleeve 10 on the transport plate 9 two pawls 46, 47 are fitted on an unlocking lever 23. The lower ends of pawls 46 and 47 engage the teeth of one of the detent rods 7, 8. The pawl 46 in cooperation with the fixed detent rod 7 here serves to retain the transport plate 9 at a specific level. The pawl 46 is movably mounted in relation to the guide sleeve 10 and bears through a recess to the fixedly mounted detent rod 7 and renders possible an upward displacement of the transport plate 9, by stages at the interval of the detent teeth, over the whole length of the detent rod. The transport plate 9 further possesses a forward part 48 which is arranged for pivoting against the force of two springs 50, 51 by means of a piano cord 49 or a hinge; the springs 50, 51 hold the part 48 in the horizontal position with the remaining part of the transport plate 9.

The part 48 serves to compensate for the difference of height between the forward folded edge and the rear open edge of a printed product. The forward folded edge is usually higher, so that without the compensation the uppermost periodical of a stack of printed products would be inclined. The printed product stack lies with the folded edges forward on the forward part 48, whereby the latter is pressed downward against the force of the springs 50, 51 and thus the most level possible position of the uppermost printed product is achieved.

The shifting of the transport plate 9 upwards by stages is effected by the second, freely vertically displaceable detent rod 8, the lower end of which stands according to FIG. 1 on a lever 25 which is arranged rotatably about a lever support 27 beneath the two detent rods 7, 8.

Moreover a second lever support 28 for the lever 25 is provided which serves for varying the pivot range of the lever 25. Draw cable 26, attached to the free end of lever 25, is looped around and secured to the pulley 29 of the turning device.

Above the transport plate 9, according to FIG. 1, a push plate 11 is arranged which is held by guide rods 12, 33 which are an integral part of a shaft 13. This shaft 13 is held by a horizontal stirrup piece 14. A strip 15 is connected by means of a connecting plate 32 with a further strip 16 and the stirrup piece 14, thereby forming a parallelogram so that the guide rods 12, 33 always stand vertically. The other end of the stirrup piece 14 is retained by a lateral part 31. The lower ends of the strips 15, 16 and of the lateral part 31 are suitably rotatably mounted in the lateral housing walls. The push plate 11, guided by the guide rods 12, 33, is displaceable in height by means of retaining rings 34, 35 which are screwed, for example on to the push rods 12, 33. The retaining rings 34, 35 serve to keep the push plate from falling during the insertion of the stack of printed products. The retaining rings 34, 35 can further consist of drilled-through rubber or other flexible material which can be displaced in a slip proof manner on the guide rods 12, 33. The entire push mechanism thus forms a U-shaped frame which is opened downwards and in the opening of which the push plate 11 is suspended.

The push plate 11 is illustrated in greater detail in FIGS. 3 and 4.

The push plate 11 possesses, on two outer corners of one of its long sides, two bores 36, 37 for the passage of the guide rods 12, 33. The push plate 11 further possesses, on its rear edge, two downwardly pointing gripper brackets 38, 39 bent back through 180° (see FIG. 4). Brackets 38, 39 are adjustable in height in relation to the push plate 11 by means of locking devices 40, 41, which can be screws. The gripper brackets 38, 39 extend beneath the entire narrow width of the push plate 11 and are bent over at their forward ends around a shaft 45 extending along the forward edge of the push plate 11. The shaft 45 is retained in retaining clips 42, 43 and 44. The locking devices 40, 41 prevent pivoting of the gripper brackets 38, 39 downwards during the insertion of the printed product stack. On the other hand they give a certain clearance to the gripper clips 38, 39 so that these always rest on the uppermost printed product of the stack, even if the push plate 11 should be lifted slightly away from the stack due by the guide pins 12, 33. The side part 31 of the stirrup piece 14 is suitably connected with the bevel wheel 5 in accordance with FIG. 5, so that the side part 31, the stirrup piece 14, and the push plate 11, on rotation of the bevel wheel, are pivoted first to the rear (phase 1) and then forward (phase 2), which will be explained more precisely hereinafter.

Moreover the push plate 11 possesses a recess 30 which extends from the rear edge to shortly before the forward edge. Beneath this recess 30 a height regulator is arranged consisting of a bar 17 having an upper angle piece 18 and a lower angle piece 53. The bar 17 is retained by guides 19, 20, and is mounted for free vertical displacement. The upper angle piece 18 fits into the recess 30 of the push plate 11.

The function of the described device for the delivery of a printed product is as follows:

First a stack of printed products is introduced into the device, by moving the transport plate 9 completely downward after pivoting the unlocking lever 23 to move the pawls 46, 47 out of engagement with the detent rods 7, 8. Then the stack of printed products is placed upon the transport plate, the folded edges of the printed products lying forward. The top of the printed product stack is adjusted for correct operational position, that is, the stack is adjusted to the correct operating height. The push plate 11 is placed upon the uppermost printed product, the retaining rings 34, 35 being adjusted according to the necessary height. Now after closure of the front plate the device is ready for delivery.

After the appropriate money has been inserted into the coin slot 2 and has passed the coin mechanism 3, the turning device is released.

First the purchaser rotates the twist knob to the right, so that the side stirrup piece 31 (for example screwed to the bevel wheel 5), the stirrup piece 14, and the other side stirrup pieces 15, 16, are pivoted by means of the pinion 6 from the front of the housing to its rear wall. As a result of this rearward motion the push plate 11, guided by the guide rods 12, 33 of the shaft 13, is pushed back over the whole width of the uppermost copy of the printed product stack until the gripper brackets 38, 39 of the push plate 11 drop over the rear edge of the printed product.

At the same time the pulley 29 fitted on the end of the shaft 59 is rotated to the right, whereby the lever 25 is lifted by means of the draw cable 26. Thus the freely movable detent rod 8, the lower end of which stands upon the lever 25, is lifted. In the lifting of the detent rod 8 the pawl 47 associated with it engages a higher tooth and thus lifts tthe transport plate by one tooth or—according to requirement—correspondingly further teeth, while the pawl 46 pertaining to the immovable detent rod 7 is relieved of load and moved by the transport plate 9.

The pawl 46 possesses in its upper part, on the side facing the detent rod 7, a small elongated recess in which a compression spring 63 is arranged. This compression spring 63 bears against the turned-over portion of the transport plate 9.

This pawl 46 now engages in the next higher tooth (or the next) of the immovable detent rod 7, whereby the transport plate 9 is lifted to a new level. The lifting of the transport plate 9 effected at each printed product sale is to compensate for the diminished height of the printed product stack due to the sale of the uppermost printed product, thereby keeping the top of the stack at a constant level. After the rotation of the twist knob 4 to the right as far as a stop, the first phase of the movement of the push mechanism and of the transport mechanism is concluded.

The second phase encompasses the rotation of the twist knob 4 back to the left again until a stop. Thus the side stirrup piece 31, the two other side stirrup pieces 15, 16, and the push plate 11 are pivoted back in the direction of the front plate 57. The gripper brackets 38, 39 of the push plate 11 now engage the uppermost printed product and push this product forward through the delivery slot 56, whereby the folded edge of the printed product passes through the delivery slot 56. The printed product extending half way out of the device can now easily be grasped and withdrawn completely by the purchaser.

Simultaneously with the rotation of the twist knob 4 back to the left the lever 25 is again pivoted back about its lever support 27 so that the freely movable detent rod 8 drops back again due to its own weight. For the sale of the next printed product the freely movable detent rod 8 can again, move the transport plate upwards by one tooth or lifting of the lever 25.

Without regulation, every lifting of the transport plate 9 would have to correspond exactly to the thickness of the respective printed product. Regulation is achieved by the height regulator consisting of the rod 17 and the two angle pieces 18, 53 extending horizontally therefrom. The upper angle piece 18 of rod 17 rests on the uppermost copy of the printed product stack. The lower angle piece 53 of the rod 17 is situated below the lever 25 and, in the case of appropriate printed product height corresponding to the interval between two teeth of the detent rod, outside the range of action of the lever 25. Where this operationally correct height of the printed product stack does not appear the lower angle piece 53 prevents a complete return of the lever 25. The lever 25, before reaching its end position, bears on the lower angle piece 53 of the rod 17 and thus prevents the movable detent rod 8 from slipping down completely into its lowermost position. Since the pawl 47 pertaining to it does not engage completely in this position of the lever 25, at the next stroke a certain idle motion occurs which does not suffice to lift the transport plate 9 by one tooth into the next higher tooth. Only after the sale of a further printed product do the lever 25, and thus also the freely movable detent rod 8, reach their lowermost positions so that in the subsequent third sale of a printed product the transport plate 9 and thus the printed product stack are again lifted by one tooth of the fixed detent rod 7.

The tooth interval of the detent rods 7, 8 is selected so that it corresponds approximately to the thickness of the normal printed product, for example the interval amounts to 5 mm. Accordingly a corresponding draw cable stroke of the cable 26, a minimum lift of the transport plate 9 by one tooth each time, that is for example by 5 mm, is possible. This would be the optimum setting for printed products, the thickness of which corresponds at maximum to the interval between two teeth. Some printed products are thicker, however, having for example a thickness between 5 mm. and 10 mm. Therefore for the first setting stage a standard stroke of two teeth interval is fixed, that is 10 mm. in the example selected. This results in a maximum level tolerance of 9 mm. in the case of a printed product for example of 1 mm. thickness. This tolerance is harmless during operation and reduces the necessity of converting the device for different printed products. In the case of printed products whose thickness is greater than in the example explained here, that is, greater than the interval between two teeth, the second setting is effected to four teeth or for example a stroke of 20 mm., which again produces a maximum level tolerance of 9 mm. This different setting to two different height stages, of two tooth intervals and four tooth intervals respectively is effected by shifting the pivot point of the lever 25 between lever supports 27 and 28 (FIG. 1).

For the conversion the lever 25 has a semi-circular groove on the under side at its pivot point, in which the lever supports 27 or 28 fit. A leaf spring 60 on the under side of the lever 25 holds the latter firmly on the lever support 27 or 28. The lever 25 can be lifted and taken out of the retention against the pressure of the leaf spring 60, in order for example to be articulatedly connected with the lever support 28.

Figure 11:
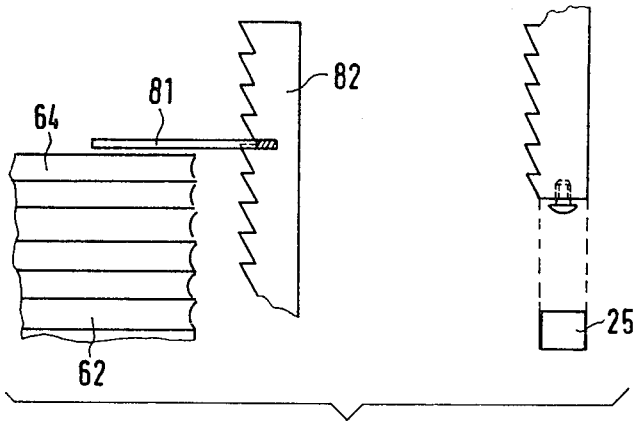
FIG. 11 shows a further example of a movable detent rod for vertical displaceability.

A further possible embodiment for the height regulation is characterised in FIG. 11.

On a vertically displaceable detent rod 82, at the point to which the printed product stack 62 is to be lifted at maximum, a threaded bolt 81 is screwed into a threaded hole in the detent rod 82 at right angles, that is to say, bolt 81 is attached horizontally and directed forwards. This bolt 81, when the detent rod 82 is unloaded, rests in each case on the uppermost periodical 64. Due to the elimination of the separate height regulator 17 (FIG. 1), after every service operation the lever 25 drops back into its lowermost position while the movable detent rod 82, according to the loss of height effected in accordance with the thickness of the periodical, is held in the corresponding position. Only in the case of a periodical thickness which corresponds to the set distance would the detent rod 82 stand on the lever 25. In the case of slighter periodical thicknesses it remains stationary above the lever in a position corresponding to the height loss. Thus the detent rod 82 is not completely lifted at the next service operation.

Figure 12:
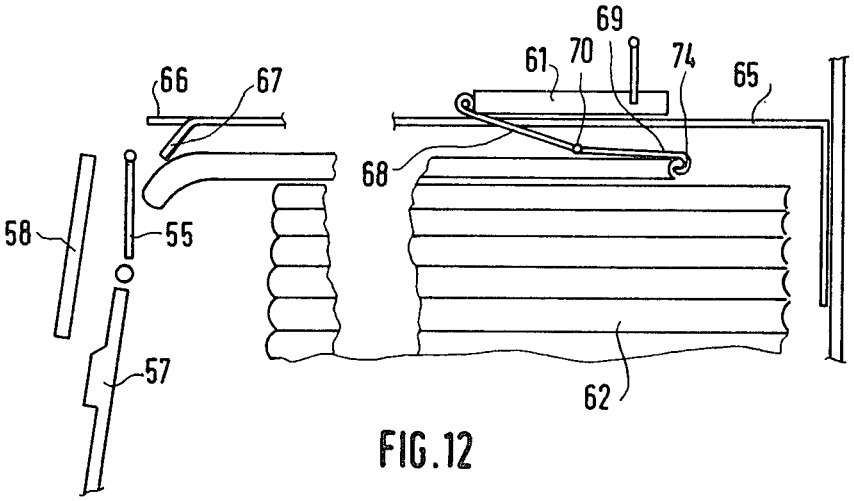
FIG. 12 shows a further example of a push plate with movable hinge grippers.
Figure 13:
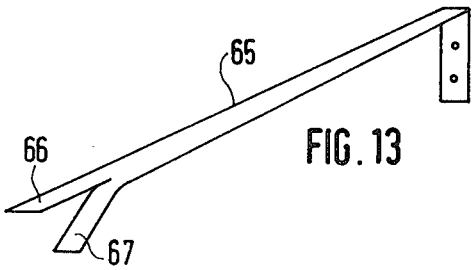
FIG. 13 shows a rod on which the push plate according to FIG. 12 rests in sliding manner.

FIG. 12 shows a further example of embodiment of a push plate 61 which is here slidably arranged on two rods 65. These rods 65 are preferably angle pieces which are secured with one flange on the transport plate 9 in a suitable manner, the horizontal flange protruding in the delivery direction of the periodicals and carrying the push plate 61. The free end of the horizontal flange of the angle piece 65 is split longitudinally as shown in FIG. 13, forming two halves 66, 67, the one half 67 being bent away downwards. This downwardly bent half serves for the guidance of the fold of the uppermost printed product as it is withdrawn from the stack of printed products.

For the grasping of the uppermost printed product the push plate 61 possesses two hinge grippers consisting of two plates 68, 69 which are movably connected with one another by means of a hinge 70. The plate 68 is in turn movably arranged on the push plate 61. Due to the fact that the push plate 61 is carried by the rods 65, every unnecessary pressure upon the periodical stack is avoided, which is advantageous especially for this periodicals of low weight.

Figure 14:
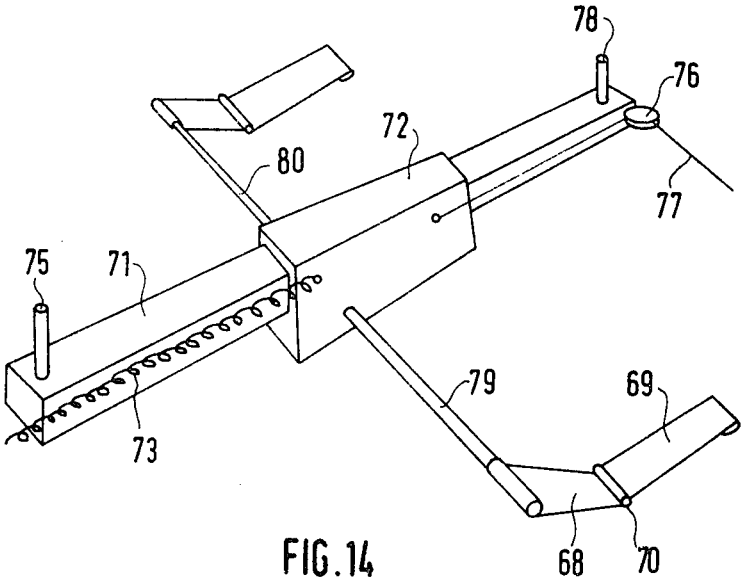
FIG. 14 shows a perspective view of a further embodiment of a gripper mechanism with hinge grippers.
Figure 15:
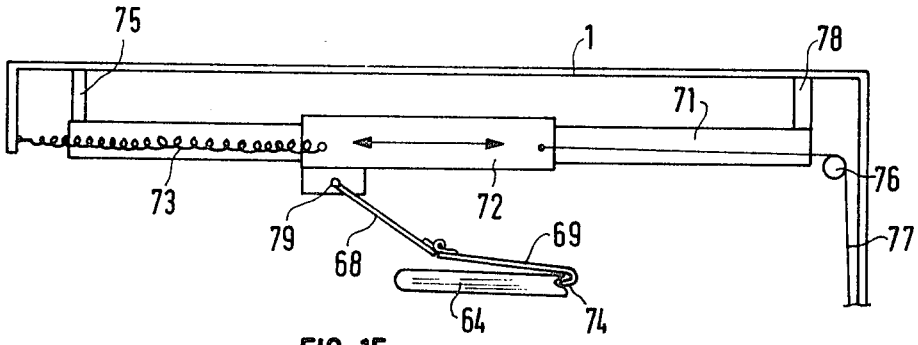
FIG. 15 shows a lateral view of FIG. 14, the guide rod being illustrated here as installed in the housing.

In FIGS. 14 and 15 a further example of embodiment for the push mechanism is illustrated. Here the push mechanism according to FIGS. 1 to 10, consisting of the downwardly opened U-shaped stirrup piece 14, 15, 16, the bevel wheel 5, the pinion 6 and the push plate 11, is replaced by the following mechanism:

A guide rod 71, which ordinarily is a square rod, is, firmly attached to the upper side of the housing by spacing bolts 75, 78. Guide rod 71 extends horizontally, above the periodical stack, in a direction parallel with the delivery direction of the periodicals. On this rod there slides a sleeve 72 having one end attached to a tension spring 73 the other end of which is secured to the housing (FIG. 15). The sleeve carries laterally, on each of two opposite sides, horizontally protruding rods 79, 80 on the ends of which the hinge grippers 68, 69 are pivotably secured. In the delivery operation (rotation of the operating knob to the right) the sleeve is drawn back against the rear wall of the housing, by means of a draw cable 77 running over two deflector pulleys 76, until the hinge grippers engage in the uppermost printed product 64, (FIG. 15). This product is then forward through the delivery slot in the front panel of the housing upon rotation of the operating knob to the left, by reason of the spring force of the tension spring 73.

I claim:

1. An apparatus for dispensing printed products from a stack, comprising: a housing having a delivery slot therein; turning device means for manual operation to deliver a printed produt through said delivery slot; a first toothed detent rod fixedly mounted in a vertical position within said housing opposite said delivery slot; a second toothed detent rod mounted for parallel movement adjacent said first rod; a horizontally extending transport plate mounted adjacent said first and second rods for movement along a line parallel thereto; first and second pivotable pawls operationally mounted on said transport plate and positioned to engage the teeth of said first and second rods, respectively; push plate means pivotably mounted above said transport plate and operationally connected to said turning device means for expelling the printed product lying uppermost on the stack; a lever having a first end pivotably mounted to said housing and having a second end operationally connected to said turning device means, said lever extending approximately horizontally beneath said first and second rods, said second rod being positioned to stand on said lever; and height regulator means cooperating with said second rod for regulating the height of the top product of said printed product stack.

2. The apparatus according to claim 1, further comprising a stirrup piece rotatably mounted on the housing walls and movable toward said delivery slot, said push plate means being operationally connected to said stirrup piece.

3. The apparatus according to claim 2, wherein said push plate means comprises hook means for grasping the printed product lying uppermost on the stack.

4. The apparatus according to claim 1 or 2, wherein said height regulator means comprises a third rod mounted within said housing for movement along a line parallel to said first and second rods, said third rod having an upper and a lower horizontal angle piece, the upper piece being positioned to lie on the printed product stack and the lower piece extending beneath the lever.

5. The apparatus according to claim 1, wherein said turningdevice means has a drive shaft, and further comprising means operationally connecting said drive shaft and the second end of said lever for moving said lever upward when said turning device means is manually turned.

6. The apparatus according to claim 5, further comprising a pinion mounted on said drive shaft, a toothed wheel rotatably mounted on said housing and meshing with said pinion, and means connecting the stirrup piece and said toothed wheel for pivoting the push plate means.

7. The apparatus according to claim 1, wherein the transport plate comprises a forward part pivotably attached to a rear part, and further comprising spring means for retaining said forward part in a substantially horizontal position.

8. The apparatus according to claim 1, wherein said height regulator means comprises a horizontally arranged bolt mounted on said second rod and positioned to rest on the uppermost printed product of the printed product stack.

9. The apparatus according to claim 1, wherein the push plate means comprises at least one hinge gripper consisting of two plates movably connected by a hinge, one plate being pivotably secured on the push plate means and the other plate having gripper hook.

10. The apparatus according to claim 1, further comprising a sixth rod fixedly mounted within said housing, said sixth rod extending horizontally in the delivery direction of the printed product, a sleeve slidably mounted on said sixth rod, a tension spring connecting said sleeve and the housing, seventh and eighth rods extending from each side of said sleeve, and two hinge grippers secured respectively to said seventh and eighth rods.

11. An apparatus for dispensing folded or stitched printed products such as newspapers or periodicals, said apparatus being of the type which includes a housing with an automatic coin system and a turning device which is rotated after coin insertion to deliver a printed product through a delivery slot, the housing having therein two perpendicular detent rods arranged parallel to one another, one detent rod being arranged fixedly and the other being arranged to move upwards and downwards, and a transport plate for carrying the printed product stack arranged for upward and downward movement adjacent the detent rods, the transport plate having two pivotable pawls for engagement with the two detent rods, wherein the improvement comprises:

the detent rods (7, 8) are arranged side by side on the housing rear wall and the transport plate (9) is arranged horizontally, and further comprising a push plate (11) displaceably arranged above the transport plate, the push plate having gripper means (38, 39, 74) for expelling the printed product lying uppermost on the stack, a lever (25) pivotable about an axis (27) arranged beneath the ends of the detent rods and approximately horizontally along the housing rear wall, on which lever the movable detent rod stands freely, and a draw cable (46) operationally connected between the free end of the lever and the turning device (4).

12. An apparatus according to claim 11, further comprising a front plate (57) mounted on the housing, and a horizontally arranged stirrup piece (14) having lateral parts (15, 16, 31) rotatably mounted at the lower ends thereof on the lateral housing walls, the push plate (11) being supported by the stirrup piece and being movable towards the front plate.

13. An apparatus according to claim 11, further comprising at least one hinge gripper means (68, 69) mounted on the push plate (61) for grasping the uppermost printed product (64), each at least one hinge gripper means including two plates (68, 69) movably connected to one another by a hinge (70), one plate being pivotably secured to the push plate (61) and the other plate having a gripper hook (74).

14. An apparatus according to claim 11, further comprising a rod (71) fixedly arranged on the housing above the printed product stack (62), the rod extending horizontally in the delivery direction of the printed product, a sleeve (72) sliding in a guided manner on the rod, or tension spring (73) secured between the rod and the housing (1), the sleeve having rods (79, 80) extending from each side thereof to which hinge grippers (68, 69) are secured.

15. An apparatus for dispensing folded or stitched printed products such as newspapers or periodicals, said apparatus being of the type which includes a housing with an automatic coin system and a turning device which is rotated after coin insertion to deliver a printed product through a delivery slot, the housing having therein two perpendicular detent rods arranged parallel to one another, one detent rod being arranged fixedly and the other being arranged to move upwards and downwards, and a transport plate for carrying the printed product stack arranged for upward and downward movement adjacent the detent rods, the transport plate having two pivotable pawls for engagement with the two detent rods, wherein the improvement comprises:

the detent rods (7, 8) are arranged side by side on the housing rear wall and the transport plate (9) is arranged horizontally, and further comprising a push plate (11) displaceably arranged above the transport plate, the push plate having gripper means (38, 39, 74) for expelling the printed product lying uppermost on the stack, a lever (25) pivotable about an axis (27) arranged beneath the ends of the detent rods and approximately horizontally along the housing rear wall, on which lever the movable detent rod stands freely, a draw cable (46) operationally connected between the free end of the lever and the turning device (4), and a rod (17) perpendicularly arranged on the housing rear wall for upward and downward displacement, the rod including an upper and lower horizontal angle piece (18, 53), the upper piece lying on the printed product stack and the lower piece extending beneath the lever (25).

16. An apparatus according to claim 15, further comprising a pinion (6) mounted on the drive shaft (59) of the turning device, the pinion engaging a toothed wheel (5) operationally connected to the stirrup piece (31) for the pivoting of the push plate (11).

17. An apparatus for dispensing folded or stitched printed products such as newspapers or periodicals, said apparatus being of the type which includes a housing with an automatic coin system and a turning device which is rotated after coin insertion to deliver a printed product through a delivery slot, the housing having therein two perpendicular detent rods arranged parallel to one another, one detent rod being arranged fixedly and the other being arranged to move upwards and downwards, and a transport plate for carrying the printed product stack arranged for upward and downward movement adjacent the detent rods, the transport plate having two pivotable pawls for engagement with the two detent rods, wherein the improvement comprises:

the detent rods (7, 8) are arranged side by side on the housing rear wall and the transport plate (9) is arranged horizontally, and further comprising a push plate (11) displaceably arranged above the transport plate, the push plate having gripper means (38, 39, 74) for expelling the printed product lying uppermost on the stack, a lever (25) pivotable about an axis (27) arranged beneath the ends of the detent rods and approximately horizontally along the housing rear wall, on which lever the movable detent rod stands freely, a draw cable (46) operationally connected between the free end of the lever and the turning device (4), and a horizontally arranged bolt (81) extending from the movable detent rod (82), the bolt being positioned to rest on the uppermost printed product (64) of the printed product stack (62).

* * * * *